US011725343B2

(12) United States Patent
Yanagawa et al.

(10) Patent No.: US 11,725,343 B2
(45) Date of Patent: Aug. 15, 2023

(54) CLEANING APPARATUS AND FIBER STRUCTURE MANUFACTURING APPARATUS

(71) Applicant: SEIKO EPSON CORPORATION, Tokyo (JP)

(72) Inventors: Hayato Yanagawa, Nagano (JP); Makoto Sato, Nagano (JP); Makoto Kawamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/656,898

(22) Filed: Mar. 29, 2022

(65) Prior Publication Data

US 2022/0316136 A1 Oct. 6, 2022

(30) Foreign Application Priority Data

Mar. 31, 2021 (JP) ..... 2021-059708

(51) Int. Cl.
*D21F 1/32* (2006.01)
*D21F 1/00* (2006.01)
*D21F 3/02* (2006.01)

(52) U.S. Cl.
CPC ..... *D21F 1/325* (2013.01); *D21F 1/0027* (2013.01); *D21F 3/02* (2013.01)

(58) Field of Classification Search
CPC ..... D21F 1/325; D21F 1/0027; D21F 3/02; D21F 7/00; D21F 9/00
See application file for complete search history.

(56) References Cited

U.S. PATENT DOCUMENTS

2016/0145801 A1* 5/2016 Fujita ..... D01G 25/00 162/289
2018/0347086 A1* 12/2018 Higuchi ..... D21F 1/02

FOREIGN PATENT DOCUMENTS

| | | | |
|---|---|---|---|
| EP | 3 508 638 | A1 | 7/2019 |
| JP | H08-292691 | A | 11/1996 |
| JP | 2004-027441 | A | 1/2004 |
| JP | 2008-040433 | A | 2/2008 |
| JP | 2011-112665 | A | 6/2011 |
| JP | 2018-076621 | A | 5/2018 |
| WO | 2018/043176 | A1 | 3/2018 |

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A cleaning apparatus includes a cleaning roller configured to rotate about a first rotation axis to clean a component to which paper dust is attached, the cleaning roller having a first area and a second area that is adjacent to the first area in a direction along the first rotation axis and to which more paper dust is attached than to the first area, and a remover configured to rotate about a second rotation axis extending in a direction different from the first rotation axis and configured to come in contact with at least a portion of the second area to remove the paper dust from the second area.

11 Claims, 5 Drawing Sheets

CLEANING APPARATUS AND FIBER STRUCTURE MANUFACTURING APPARATUS

The present application is based on, and claims priority from JP Application Serial Number 2021-059708, filed Mar. 31, 2021, the disclosure of which is hereby incorporated by reference herein in its entirety.

BACKGROUND

1. Technical Field

The present disclosure relates to a cleaning apparatus and a fiber structure manufacturing apparatus.

2. Related Art

A dry fiber structure manufacturing apparatus that uses as little water as possible has been proposed recently. As disclosed in JP-A-2018-076621, a fiber structure manufacturing apparatus includes a defibrator that defibrates a material into defibrated substances, an accumulation unit that allows the defibrated substances to be an accumulation thereon, a transportation unit that transports the accumulation, and a forming unit that forms the accumulation into a sheet-like shape.

Furthermore, the apparatus in JP-A-2018-076621 includes a brush to remove paper dust from the transportation roller. The brush comes in contact with the rotating transportation roller, allowing the brush to clean the transportation roller.

However, the brush in the known technology is positionally fixed, which results in insufficient removal of paper dust. Furthermore, the brush in the known technology comes in contact with the entire area of the transportation roller, which results in insufficient removal of paper dust particularly over an area where paper dust is more likely to attach.

SUMMARY

According to an aspect of the present disclosure, a cleaning apparatus includes a cleaning roller configured to rotate about a first rotation axis to clean a component to which paper dust is attached, the cleaning roller having a first area and a second area that is adjacent to the first area in a direction along the first rotation axis and to which more paper dust is attached than to the first area, and a remover configured to rotate about a second rotation axis extending in a direction different from the first rotation axis and configured to come in contact with at least a portion of the second area to remove the paper dust from the second area.

According to another aspect of the present disclosure, a fiber structure manufacturing apparatus includes an accumulation unit on which a fiber-containing material is accumulated to form an accumulation, a forming unit including a pressure portion that applies a pressure to the accumulation to form the accumulation into a sheet-like shape, and a cleaning apparatus configured to clean the pressure portion. The cleaning apparatus includes a cleaning roller configured to rotate about a first rotation axis to clean the pressure portion to which paper dust is attached, the cleaning roller having a first area and a second area that is adjacent to the first area in a direction along the first rotation axis and to which more paper dust is attached than to the first area, and a remover configured to rotate about a second rotation axis extending in a direction different from the first rotation axis and come in contact with at least a portion of the second area to remove the paper dust from the second area.

DESCRIPTION OF EXEMPLARY EMBODIMENTS

Figure 1:
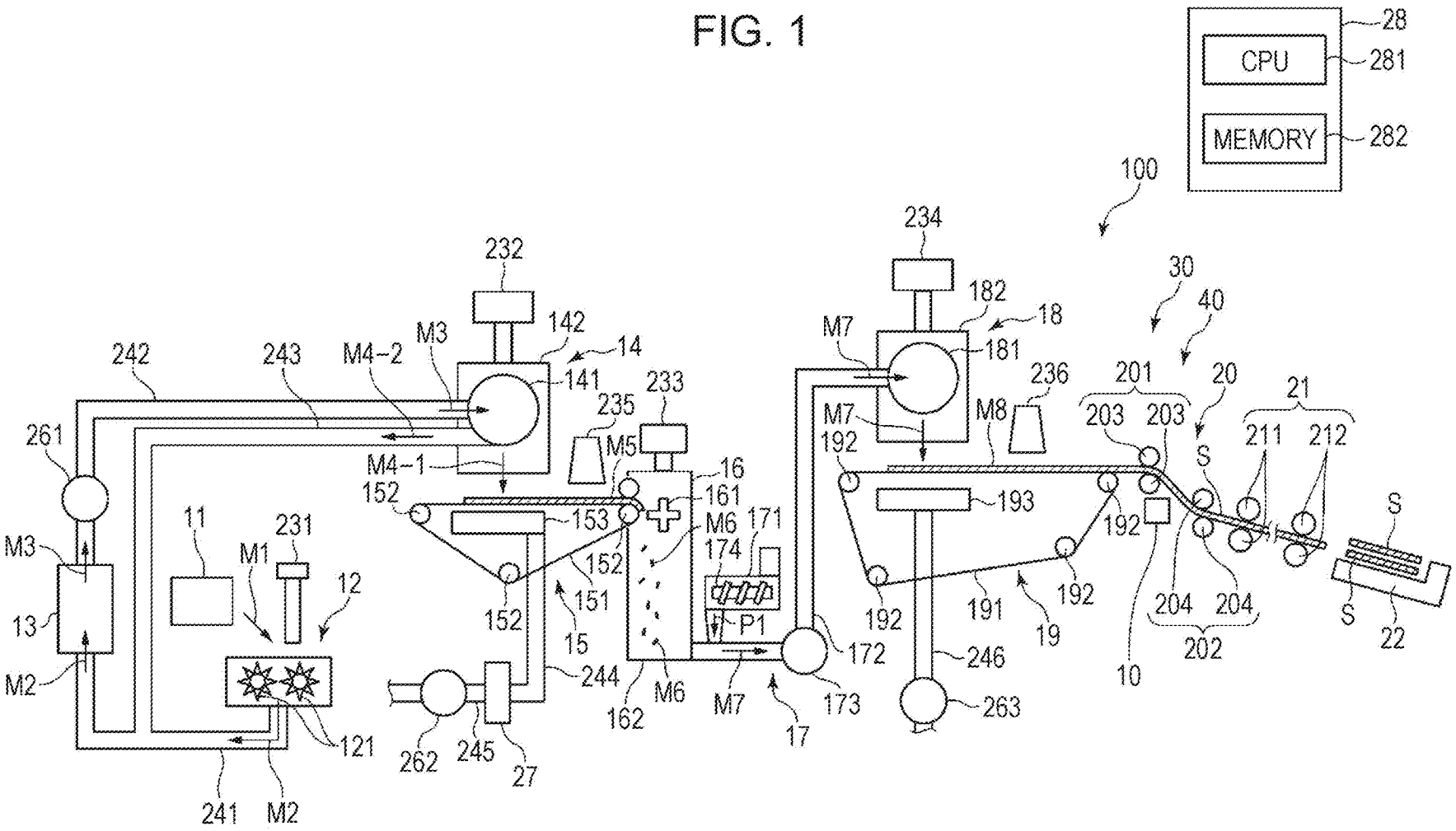
FIG. 1 is a schematic side view illustrating a fiber structure manufacturing apparatus according to a first embodiment.

Hereinafter, a cleaning apparatus and a fiber structure manufacturing apparatus according to aspects of the present disclosure will be described in detail with reference to embodiments illustrated in the drawings.

First Embodiment

Figure 2:
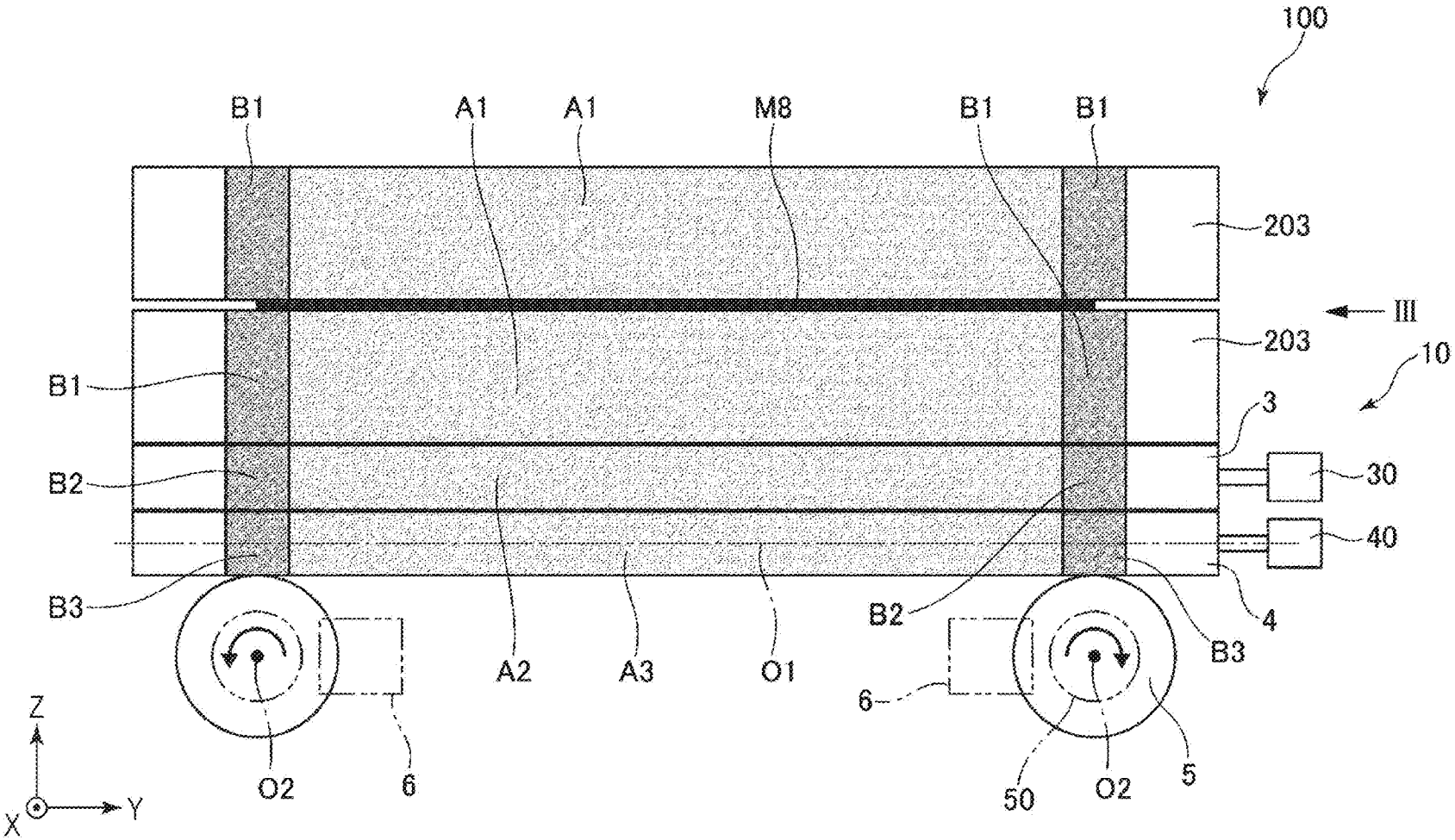
FIG. 2 is a schematic view illustrating a cleaning apparatus included in the fiber structure manufacturing apparatus illustrated in FIG. 1.
Figure 3:
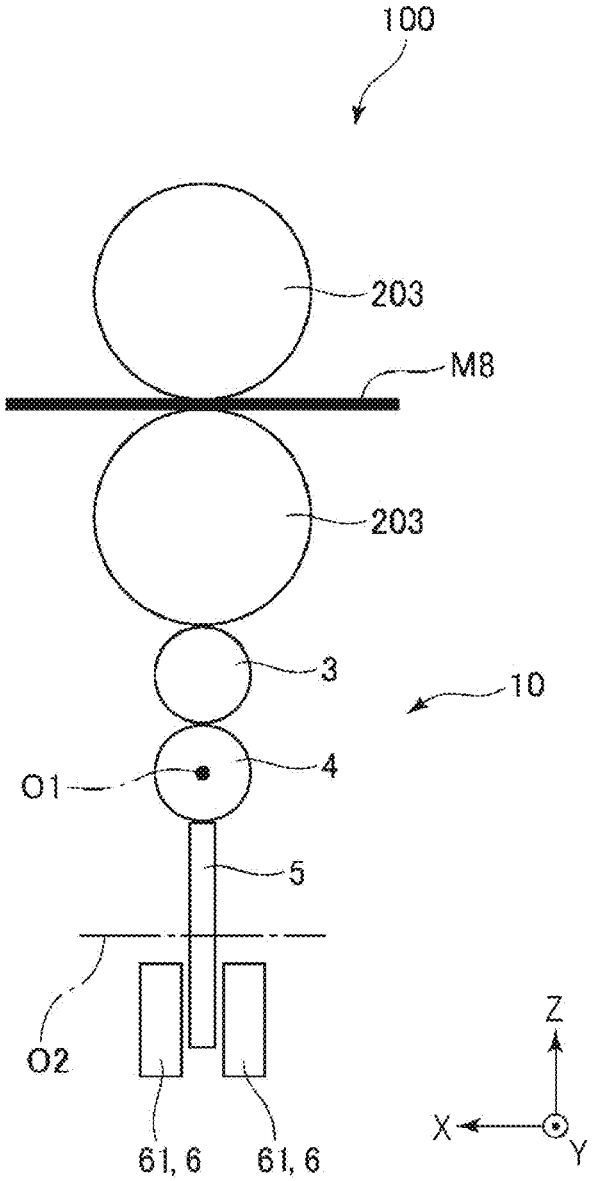
FIG. 3 is a view of the cleaning apparatus viewed in a direction indicated by the arrow III in FIG. 2.
Figure 4:
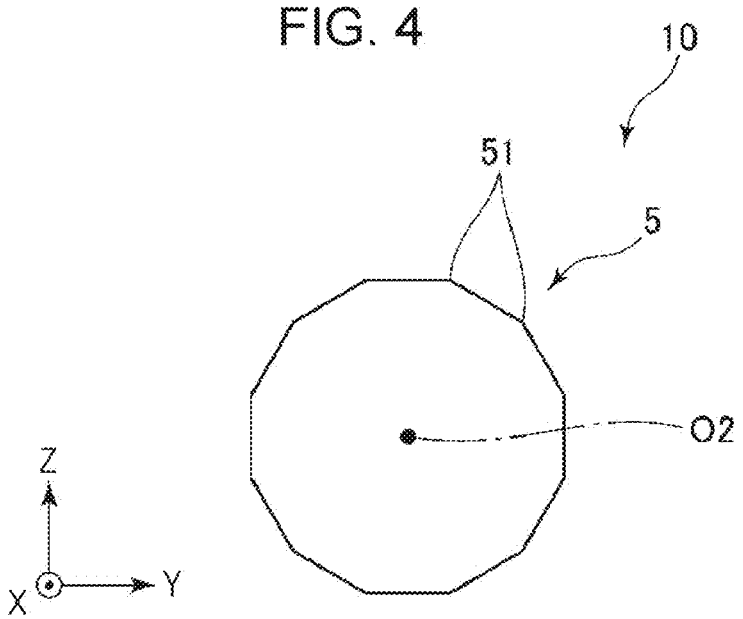
FIG. 4 is a plan view illustrating a modification of a remover.

FIG. 1 is a schematic side view illustrating a fiber structure manufacturing apparatus according to a first embodiment. FIG. 2 is a schematic view illustrating a cleaning apparatus included in the fiber structure manufacturing apparatus illustrated in FIG. 1. FIG. 3 is a view of the cleaning apparatus viewed in a direction indicated by the arrow III in FIG. 2. FIG. 4 is a plan view illustrating a modification of a remover.

In the following description, as illustrated in FIGS. 2 to 4, three axes perpendicular to each other are defined as X, Y, and Z axes for illustrative purposes. An X-Y plane parallel to the X axis and the Y axis extends horizontally. The Z axis extends vertically. The directions pointed by the arrows of the axes are prefixed with "+" and the opposite directions are prefixed with "−".

FIG. 1 is a schematic configuration diagram. The positional relationship between the components of the actual fiber structure manufacturing apparatus 100 is different from that in FIG. 1. In FIG. 1, a transportation direction is a direction in which a material M1, a coarsely crushed piece M2, a defibrated substance M3, a first sorted substance M4-1, a second sorted substance M4-2, a first web M5, a fractionized substance M6, a mixture M7, a second web M8, and a sheet S are transported, or a direction indicated by arrows. A side indicated by the head of the arrow is referred to as "downstream" in the transportation direction and a side indicated by the tail of the arrow is referred to as "upstream" in the transportation direction.

As illustrated in FIG. 1, the fiber structure manufacturing apparatus 100 of the present disclosure is an apparatus that manufactures a formed article by coarsely crushing and defibrating the material M1, mixing a bonding material into the material M1, accumulating the mixture, and forming the accumulation into a certain shape by the forming unit 20.

The formed article manufactured by the fiber structure manufacturing apparatus 100 may be a sheet-shaped article such as recycled paper or a block-shaped article. The formed article may have any density. The formed article may have a relatively high fiber density as a sheet or may have a relatively low fiber density as a sponge or may have characteristics of both of the high-density article and the low-density article.

In the following description, the material M1 is waste paper, which has been used or unwanted, and the formed article to be manufactured is recycled paper in the form of a sheet S.

As illustrated in FIG. 1, the fiber structure manufacturing apparatus 100 includes a material feeder 11, a coarse crusher 12, a defibrator 13, a sorter 14, a first web forming unit 15, a comminutor 16, a mixer 17, a discharger 18, a second web forming unit 19, a forming unit 20, a cutting unit 21, a storage 22, a collection portion 27, a cleaning apparatus 10, and a controller 28 that controls operations of these components.

The fiber structure manufacturing apparatus 100 performs, in this order, a material feeding step, a coarsely crushing step, a defibrating step, a sorting step, a first web forming step, a fractionizing step, a mixing step, a second web forming step, a sheet forming step, and a cutting step.

Hereinafter, configurations of the components are described.

The material feeder 11 performs the material feeding step of feeding the material M1 to the coarse crusher 12. The material M1 is a sheet-like material formed of a fiber-containing material containing a cellulose fiber. The cellulose fiber may be any fibrous material containing cellulose as a main compound. The cellulose fiber may contain hemicellulose or lignin in addition to the cellulose. The material M1 may be in any form, such as a woven cloth and a non-woven cloth. The material M1 may be recycled paper produced by defibrating and regenerating waste paper or may be a synthetic paper YUPO (registered trademark) or may be paper other than the recycled paper. In this embodiment, the material M1 is waste paper that has been used or unwanted.

The coarse crusher 12 performs the coarsely crushing step of coarsely crushing the material M1 fed by the material feeder 11 in air such as ambient air to produce the coarsely crushed pieces M2. The coarse crusher 12 includes two coarsely crushing blades 121. The material M1 is coarsely crushed into the coarsely crushed pieces M2 when passing between the rotating coarsely crushing blades 121. The coarsely crushed pieces M2 produced by the coarse crusher 12 are transported through a tube 241 to the defibrator 13.

The defibrator 13 performs the defibrating step of defibrating the coarsely crushed piece M2 in air, or dry-defibrating the coarsely crushed piece M2. In the defibrator 13, the coarsely crushed piece M2 is defibrated into the defibrated substances M3. Here, the term "defibrating" means separating the coarsely crushed piece M2, which is composed of multiple fibers bonded together, into individual fibers. The separated fibers are the defibrated substances M3. The defibrated substance M3 has a linear shape or a band-like shape. The defibrated substances M3 may be tangled into a small mass or may have a "lump".

In this embodiment, the defibrator 13 includes, for example, a rotary blade that rotates at high speed and an impeller mill having a liner located outward from the rotary blade. The coarsely crushed piece M2 that has flowed into the defibrator 13 is defibrated while being sandwiched between the rotary blade and the liner.

The defibrator 13 creates a current of air or air stream flowing from the coarse crusher 12 toward the sorter 14 by rotation of the rotary blade. This enables the coarsely crushed piece M2 in the tube 241 to be suctioned into the defibrator 13. Furthermore, this enables, after the defibration, the defibrated substance M3 to be sent to the sorter 14 through a tube 242.

The blower 261 is disposed along the tube 242. The blower 261 is an air stream generator that generates air stream flowing toward the sorter 14. The blower 261 accelerates the transportation of the defibrated substance M3 toward the sorter 14.

The sorter 14 performs the sorting step of sorting the defibrated substances M3 according to the fiber length. In the sorter 14, the defibrated substances M3 are sorted into first sorted substances M4-1 and second sorted substances M4-2 larger than the first sorted substances M4-1. The first sorted substance M4-1 has a size suitable for a subsequent step of producing the sheet S. The average length of the first sorted substances M4-1 is preferably not less than 1 μm and not more than 30 μm. The second sorted substance M4-2 includes, for example, insufficiently defibrated fibers and too much coagulated defibrated fibers.

The sorter 14 includes a drum 141 and a housing 142 housing the drum 141.

The drum 141 has a meshed cylindrical body and is a sieve that rotates about the central axis thereof. The defibrated substance M3 flows into the drum 141. When the drum 141 is rotated, the defibrated substance M3 smaller than the sieve opening is sorted as the first sorted substance M4-1 and the defibrated substance M3 larger than the sieve opening is sorted as the second sorted substance M4-2. The first sorted substance M4-1 falls from the drum 141.

The second sorted substance M4-2 is sent to a tube 243 coupled to the drum 141. The tube 243 is coupled to the tube 241 at the downstream end remote from the drum 141. The second sorted substance M4-2 passes through the tube 243 to join the coarsely crushed piece M2 in the tube 241 and flows into the defibrator 13 together with the coarsely crushed piece M2. In this way, the second sorted substance M4-2 returns to the defibrator 13 to be defibrated together with the coarsely crushed piece M2.

The first sorted substances M4-1 falls from the drum 141 toward the first web forming unit 15 located below the drum 141 while being dispersed in the air. The first web forming unit 15 performs the first web forming step of forming the first web M5 from the first sorted substances M4-1. The first web forming unit 15 includes a mesh belt 151, three tension rollers 152, and a suctioning portion 153.

The mesh belt 151 is an endless belt on which the first sorted substance M4-1 is accumulated. The mesh belt 151 is wound on the three tension rollers 152. When the tension rollers 152 are rotated, the first sorted substance M4-1 on the mesh belt 151 is transported downstream.

The first sorted substance M4-1 is larger than the mesh openings of the mesh belt 151. Thus, the first sorted substance M4-1 does not pass through the mesh belt 151 and accumulates on the mesh belt 151. The first sorted substance M4-1 being accumulated on the mesh belt 151 is transported downstream together with the mesh belt 151 and thus a layered first web M5 is formed.

In some cases, the first sorted substance M4-1 contains grit and dust, for example. The grit and dust may be generated in the coarse crushing and the defibrating, for example. The grit and dust are collected in the collection portion 27, which will be described later.

The suctioning portion 153 is a suction system for suctioning air from below the mesh belt 151. Thus, grit and dust that have been passed through the mesh belt 151 are suctioned together with air.

The suctioning portion 153 is coupled to the collection portion 27 through a tube 244. The grit and dust suctioned by the suctioning portion 153 is collected in the collection portion 27.

A tube 245 is further coupled to the collection portion 27. Furthermore, a blower 262 is disposed along the tube 245. When the blower 262 is operated, a suctioning force is generated at the suctioning portion 153. This accelerates formation of the first web M5 on the mesh belt 151. The first web M5 formed this way does not contain grit and dust. When the blower 262 is operated, the grit and dust pass through the tube 244 to the collection portion 27.

The housing 142 is coupled to the humidifier 232. The humidifier 232 is a vapor humidifier. Thus, the humidified air is supplied into the housing 142. The humidified air humidifies the first sorted substance M4-1, reducing the possibility that the first sorted substance M4-1 will be attached to the inner wall of the housing 142 by an electrostatic force.

The humidifier 235 is disposed downstream of the sorter 14. The humidifier 235 is an ultrasonic humidifier that sprays water. The moisture is supplied to the first web M5, and thus the moisture content of the first web M5 is adjusted. This adjustment reduces the possibility that the first web M5 will be attracted by an electrostatic force to the mesh belt 151. Thus, the first web M5 is readily detached from the mesh belt 151 at the tension roller 152 where the mesh belt 151 is turned.

The comminutor 16 is disposed downstream of the humidifier 235. The comminutor 16 performs the fractionizing step of fractionizing the first web M5 detached from the mesh belt 151. The comminutor 16 includes a rotatably supported propeller 161 and a housing 162 housing the propeller 161. The rotating propeller 161 fractionizes the first web M5. The first web M5 is fractionized into fractionized substances M6. The fractionized substances M6 fall in the housing 162.

The housing 162 is coupled to the humidifier 233. The humidifier 233 is a vapor humidifier, for example. Thus, humidified air is supplied into the housing 162. The humidified air reduces the possibility that the fractionized substances M6 will be attached to the propeller 161 and the inner wall of the housing 162 by an electrostatic force.

The mixer 17 is disposed downstream of the comminutor 16. The mixer 17 performs the mixing step of mixing the fractionized substance M6 and an adhesive P1. The mixer 17 includes an adhesive feeder 171, a tube 172, and a blower 173.

The tube 172 couples the housing 162 of the comminutor 16 to a housing 182 of the discharger 18. The tube 172 is a passage through which the mixture M7 of the fractionized substance M6 and the adhesive P1 passes.

The adhesive feeder 171 is coupled midway between the ends of the tube 172. The adhesive feeder 171 includes a screw feeder 174. When the screw feeder 174 is rotated, the adhesive P1 in powdered form or particle form is fed to the tube 172. The adhesive P1 fed to the tube 172 is mixed with the fractionized substance M6 to be a mixture M7.

The adhesive P1 is a bonding material that bonds the fibers in a subsequent step. Examples of the adhesive P include a thermoplastic resin, a curable resin, starch, dextrin, glycogen, amylose, hyaluronic acid, arrowroot, konjac starch, potato starch, etherified starch, esterified starch, natural gums (etherified tamarind gum, etherified locust bean gum, etherified guar gum, acacia *arabica* gum), fiber derivative glue (etherified carboxymethyl cellulose, hydroxyethyl cellulose), seaweeds (sodium alginate, agar), and animal proteins (collagen, gelatin, hydrolyzed collagen, sericin). A thermoplastic resin is preferably employed. Examples of the thermoplastic resin include polyolefins such as AS resin, ABS resin, polyethylene, polypropylene, and ethylene-vinyl acetate copolymers (EVA), a modified polyolefin, acrylic resins such as polymethyl methacrylate, polyesters such as polyvinyl chloride, polystyrene, polyethylene terephthalate, and polybutylene terephthalate, polyamides (nylon) such as nylon 6, nylon 46, nylon 66, nylon 610, nylon 612, nylon 11, nylon 12, nylon 6-12, and nylon 6-66, liquid crystal polymers such as polyphenylene ether, polyacetal, polyether, polyphenylene oxide, polyether ether ketone, polycarbonate, polyphenylene sulfide, thermoplastic polyimide, polyether imide, and aromatic polyester, various thermoplastic elastomers such as a styrene-based elastomer, a polyolefin-based elastomer, a polyvinyl chloride-based elastomer, a polyurethane-based elastomer, a polyester-based elastomer, a polyamide-based elastomer, a polybutadiene-based elastomer, a trans polyisoprene-based elastomer, a fluorocarbon rubber-based elastomer, and a chlorinated polyethylene-based elastomer, which may be used alone or in combination. Preferably, the thermoplastic resin is a polyester or includes a polyester.

The adhesive feeder 171 may feed, in addition to the adhesive P1, a colorant for coloring fibers, a coagulation inhibitor for preventing coagulation of fibers or coagulation of the adhesive P1, a flame retardant for making the fibers and other materials resistant to fire, a paper strength enhancer for enhancing the strength of a sheet S. Alternatively, the adhesive feeder 171 may feed a composite containing the above-described component(s) and the adhesive P1.

The blower 173 is disposed downstream of the adhesive feeder 171 along the tube 172. The fractionized substance M6 and the adhesive P1 are mixed by action of a rotary portion of the blower 173 such as a blade. The blower 173 also generates an air stream flowing toward the discharger 18. The air stream stirs the fractionized substance M6 and the adhesive P1 in the tube 172. Thus, the mixture M7 flows into the discharger 18 with the fractionized substance M6 and the adhesive P1 being evenly dispersed. The fractionized substance M6 in the mixture M7 is untangled when passing through the tube 172 to be finer fibers.

The discharger 18 untangles and discharges the tangled fibers in the mixture M7. The discharger 18 includes a drum 181 and a housing 182 housing the drum 181.

The drum 181 has a meshed cylindrical body and is a sieve that rotates about the central axis thereof. The mixture M7 flows into the drum 181. When the drum 181 is rotated, fibers in the mixture M7 smaller than the sieve openings pass through the drum 181. The mixture M7 is untangled when passing through the drum 181 and is released into to the air.

The housing 182 is coupled to the humidifier 234. The humidifier 234 is a vapor humidifier, for example. Thus, the humidified air is supplied into the housing 182. The humidified air humidifies the housing 182, reducing the possibility that the mixture M7 will be attached to the inner wall of the housing 182 by an electrostatic force.

The mixture M7 untangled in the drum 181 falls toward the second web forming unit 19 located below the drum 181 while being dispersed in the air. The second web forming unit 19 performs the second web forming step of forming the second web M8 from the mixture M7. The second web forming unit 19 includes a mesh belt 191, tension rollers 192, and a suctioning portion 193.

The mesh belt 191 is an endless belt on which the mixture M7 is accumulated. The mesh belt 191 is wound on the four tension rollers 192. When the tension rollers 192 are rotated, the mixture M7 on the mesh belt 191 is transported downstream. The mesh belt 191 is a component of the transportation unit that transports the second web M8 downstream.

Almost all the mixture M7 on the mesh belt 191 is larger than the mesh openings of the mesh belt 191. Thus, the mixture M7 does not pass through the mesh belt 191 and accumulates on the mesh belt 191. The mixture M7 being accumulated on the mesh belt 191 is transported downstream together with the mesh belt 191, and thus the mixture forms a layered second web M8.

The suctioning portion 193 is a suctioning system for suctioning air from below the mesh belt 191. Thus, the mixture M7 is suctioned onto the mesh belt 191, accelerating accumulation of the mixture M7 on the mesh belt 191.

The suctioning portion 193 is coupled to a tube 246. Furthermore, the blower 263 is disposed along the tube 246. When the blower 263 is operated, a suctioning force is generated at the suctioning portion 193.

The humidifier 236 is disposed downstream of the discharger 18. The humidifier 236 is an ultrasonic humidifier as the humidifier 235. Thus, the moisture is supplied to the second web M8, and thus the moisture content of the second web M8 is adjusted. The adjustment reduces the possibility that the second web M8 will be attracted by an electrostatic force to the mesh belt 191. Thus, the second web M8 is readily detached from the mesh belt 191 at a position where the mesh belt 191 is turned by the tension roller 192.

The total amount of moisture added by the humidifiers 231 to 236 is preferably not less than 0.5 parts by mass and not more than 20 parts by mass per 100 parts by mass of the material before being humidified, for example.

The forming unit 20 is disposed downstream of the second web forming unit 19. The forming unit 20 performs the sheet forming step of forming the sheet S from the second web M8. The forming unit 20 includes a pressure member 201 and a heating portion 202.

The pressure member 201 includes two calendar rollers 203 and the second web M8 is pressurized between the calendar rollers 203 without being heated. This increases the density of the second web M8. The calendar rollers 203 also function as a transportation unit that transports the second web M8 downstream. The second web M8 is transported toward the heating portion 202. One of the two calendar rollers 203 is a driving roller that is powered by a motor (not illustrated) and the other is a driven roller.

The heating portion 202 includes two heating rollers 204 and the second web M8 is pressurized while being heated between the heating rollers 204. The heating rollers 204 also function as a transportation unit that transports the second web M8 downstream. The adhesive P1 in the second web M8 is melted by the heat and pressure, and thus the fibers are bonded to each other by the melted adhesive P1. Thus, the sheet S is formed. The sheet S is then transported toward the cutting unit 21. One of the two heating rollers 204 is a driving roller that is powered by a motor (not illustrated) and the other is a driven roller.

The cutting unit 21 is disposed downstream of the forming unit 20. The cutting unit 21 performs the cutting step of cutting the sheet S. The cutting unit 21 includes a first cutting portion 211 and a second cutting portion 212.

The first cutting portion 211 cuts the sheet S in a direction intersecting the transportation direction of the sheet S, particularly in a direction perpendicular to the transportation direction of the sheet S.

The second cutting portion 212 is disposed downstream of the first cutting portion 211 and includes a rotary blade that rotates to cut the sheet S in a direction parallel to the transportation direction of the sheet S. In the cutting, both ends of the sheet S, which are unnecessary portions, are removed to make the width of the sheet S uniform. The portion cut off and removed is called a "scrap". The sheet S having a predetermined shape and a predetermined size is transported downstream to be on the storage 22.

The above-described components included in the fiber structure manufacturing apparatus 100 are electrically coupled to the controller 28. The operations of the components are controlled by the controller 28.

As illustrated in FIG. 1, the controller 28 includes a central processing unit (CPU) 281 and memory 282. The CPU 281 is configured to make various decisions and execute various instructions, for example.

The memory 282 stores various programs such as a program for producing the sheets S. Specifically described, the memory 282 stores programs for executing first, second and third modes, which will be described later.

The controller 28 may be installed in the fiber structure manufacturing apparatus 100 or may be mounted in an external device such as an external computer. The controller 28 mounted in an external device may be communicated with the fiber structure manufacturing apparatus 100 by radio or by cable.

The CPU 281 and the memory 282 may be an integral one unit. Alternatively, the CPU 281 may be installed in the fiber structure manufacturing apparatus 100 and the memory 282 may be mounted in an external device such as an external computer. Alternatively, the memory 282 may be installed in the fiber structure manufacturing apparatus 100 and the CPU 281 may be mounted in an external device such as an external computer.

The above-described controller 28 may be considered a component of the cleaning apparatus 10 or may be considered a component of the fiber structure manufacturing apparatus 100.

Next, the cleaning apparatus 10 will be described. As illustrated in FIGS. 1 to 3, the cleaning apparatus 10 is configured to clean components that come in contact with the second web M8 or the sheet S, for example. Short fibers (hereinafter, referred to as paper dust) may be attached to components that come in contact with the second web M8 or the sheet S. The cleaning apparatus 10 is an apparatus for removing the paper dust. The cleaning apparatus 10 may be provided for each of the components that come in contact with the second web M8 or the sheet S or may be provided for at least one of the components. In the following description, a cleaning apparatus 10 provided for the calendar roller 203 will be described.

As illustrated in FIG. 2, the cleaning apparatus 10 includes a felt roller 3, a driver 30 that rotates the felt roller 3, a cleaning roller 4 that removes paper dust from the felt roller 3, a driver 40 that rotates the cleaning roller 4, a remover 5 that removes paper dust from the cleaning roller 4, a driver 50 that rotates the remover 5, and a cleaner 6 that cleans the remover 5.

The felt roller 3 is long in the Y axis direction and is a roller having at least a felt surface. The felt roller 3 having this configuration is able to not only clean up paper dust but also reliably remove the adhesive P1.

In this embodiment, the felt roller 3 comes in contact with one of the calendar rollers 203 that is located on the −Z axis side to clean the calendar roller 203. The felt roller 3 is adjacent to the calendar roller 203 in the −Z axis direction and extends in the longitudinal direction of the calendar roller 203.

The felt roller 3 sweeps paper dust from the surface of the calendar roller 203 or cleans the calendar roller 203 when rotated while being in contact with the calendar roller 203.

The felt roller 3 may be eliminated. The cleaning roller 4 may directly clean the calendar roller 203 or the heating roller 204.

The driver 30 includes a motor (not illustrated) and a decelerator (not illustrated), for example, and rotates the felt roller 3. The motor of the driver 30 is electrically coupled to the controller 28 illustrated in FIG. 1 so as to be controlled by the controller 28.

The cleaning roller 4 is long in the Y axis direction and includes a brush roller. The cleaning roller 4 rotates about a first rotation axis O1 extending in the Y axis direction. In this embodiment, the cleaning roller 4 comes in contact with the felt roller 3 to clean the felt roller 3. The cleaning roller 4 is adjacent to the felt roller 3 in the −Z axis direction and extends in the longitudinal direction of the calendar roller 203.

The cleaning roller 4 sweeps out paper dust from between the felt fibers with the bristles, or cleans the felt roller 3, when rotated while being in contact with the felt roller 3.

The cleaning roller 4, which is a brush roller, efficiently cleans a component to which paper dust is attached.

The driver 40 includes a motor (not illustrated) and a decelerator (not illustrated), for example, and rotates the cleaning roller 4. The motor of the driver 40 is electrically coupled to the controller 28 illustrated in FIG. 1 so as to be controlled by the controller 28.

Here, paper dust is more likely to attach to areas B1 of the outer surface of the calendar roller 203 than to an area A1 between the areas B1. The areas B1 include areas brought into contact with end portions in the width direction, or end portions in the Y axis direction, of the second web M8 and the surrounding areas. Thus, paper dust is more likely to attach to areas B2 of the outer surface of the felt roller 3 corresponding to the areas B1 of the calendar roller 203 than to an area A2 between the areas B2. Furthermore, paper dust is more likely to attach to areas B3 of the cleaning roller 4 corresponding to the areas B2 than to an area A3 between the areas B3. The area A3 is an example of a first area. The area B3 is an example of a second area. In view of the above, the cleaning apparatus 10 includes two removers 5 that selectively remove paper dust from the areas B3 to which paper dust is more likely to attach. The removers 5 have substantially the same configuration, and thus one of the removers 5 will be described below.

The remover 5 rotates about an axis extending in a direction different from the first rotation axis O1 and comes in contact with at least a portion of the area B3 to remove paper dust from the area B3. In this embodiment, the remover 5 rotates about a second rotation axis O2 extending in a direction perpendicular to the first rotation axis O1. In other words, the remover 5 rotates about the second rotation axis O2 extending in the X axis direction. When rotated, the remover 5 sweeps out the paper dust from between the bristles of the cleaning roller 4 and cleans the cleaning roller 4.

As illustrated in FIG. 4, the remover 5 has a plate-like shape. This enables efficient cleaning of the cleaning roller 4. Specifically described, the remover 5 having a plate-like shape readily enters between the bristles of the cleaning roller 4, resulting in efficient cleaning of the cleaning roller 4. The remover 5 may have a frame-like shape.

Furthermore, as illustrated in FIG. 2, the remover 5 has a circular shape in plan view. This enables stable cleaning of the cleaning roller 4.

Furthermore, as illustrated in FIG. 4, the remover 5 may have a polygonal shape in plan view. In other words, the remover 5 may have multiple corners 51 in plan view. With this configuration, the corners 51 readily enter between the bristles of the cleaning roller 4, resulting in reliable cleaning of the cleaning roller 4. In FIG. 4, the remover 5 has 12 corners, but the number of corners 51 may be changed.

Furthermore, the remover 5 preferably has a maximum outer diameter of not less than 5 cm and not more than 30 cm in plan view, more preferably not less than 10 cm and not more than 15 cm. This does not excessively increase the size of the apparatus and allows efficient cleaning of the cleaning roller 4.

The thickness of the remover 5 is not limited, but is preferably not less than 0.01 cm and not more than 2.0 cm, more preferably not less than 0.03 cm and not more than 1.00 cm. The remover 5 having a thickness in the above range reliably enters between the bristles of the cleaning roller 4, resulting in efficient cleaning of the cleaning roller 4.

Furthermore, the remover 5 may or may not enter between the bristles of the cleaning roller 4. When the remover 5 enters between the bristles of the cleaning roller 4, the insertion depth is preferably not less than 0.1 cm and not more than 5 cm, more preferably not less than 0.2 cm and not more than 3 cm. This enables efficient cleaning of the cleaning roller 4.

The driver 50 includes a motor (not illustrated) and a decelerator (not illustrated), for example, and rotates the remover 5. The motor of the driver 50 is electrically coupled to the controller 28 illustrated in FIG. 1 so as to be controlled by the controller 28. The electric condition of the motor of the driver 50 is controlled to change the rotation speed and the rotation direction.

As described above, the cleaning apparatus 10 includes the driver 50 that rotates the remover 5 and the controller 28 that controls the driver 50. This enables cleaning of the cleaning roller 4 without manual operation of the remover 5. However, the remover 5 may be manually rotated.

Furthermore, the controller 28 rotates the remover 5 intermittently. In other words, the controller 28 controls the driver 50 to cause the remover 5 to alternate rotation and suspension. This results in efficient cleaning of the cleaning roller 4.

A ratio of T1/T2 in which T1 is the duration of rotation and T2 is the duration of suspension is preferably not less than 0.1 and not more than 10, more preferably not less than 1.0 and not more than 5.0.

The rotation speed of the remover 5 in rotation may be variable. Furthermore, the remover 5 may rotate continuously.

As described above, the component to which paper dust is attached is included in the transportation unit that transports the second web M8, which is a sheet-like object containing fiber. The area B3, which is the second area, corresponds to a position of the end portion in the Y axis direction, which intersects the X axis direction or the transportation direction, of the second web M8. With this configuration, the portions of the cleaning roller 4 to which paper dust is more likely to attach are efficiently cleaned.

Furthermore, the area A3, which corresponds to the first area, is located in a middle in the longitudinal direction of the cleaning roller 4, and the areas B3, which corresponds to the second areas, are located at the first and second end portions in the longitudinal direction of the cleaning roller 4. The two removers 5 are provided for the first and second end portions of the cleaning rollers 4. With this configuration, the two portions of the cleaning roller 4 to which paper dust is more likely to attach are both efficiently cleaned.

The remover 5 located at the left in FIG. 2 rotates in a counterclockwise direction in FIG. 2, and the remover 5 located at the right in FIG. 2 rotates in a clockwise direction in FIG. 2. This reduces the possibility that paper dust swept by the remover 5 from the cleaning roller 4 will be scattered toward the middle of the cleaning roller 4.

The remover 5 located at the left in FIG. 2 may rotate in the clockwise direction in FIG. 2, and the remover 5 located at the right in FIG. 2 may rotate in the counterclockwise direction in FIG. 2. In such a case, a collection portion that collects paper dust may be disposed at the middle of the cleaning roller 4. Paper dust can be collected with this simple configuration.

As described above, the removers 5 rotate in opposite directions. This configuration reduces scattering of paper dust toward the cleaning roller 4 or enables easy collection of paper dust.

Furthermore, the cleaning apparatus 10 includes a cleaner 6 that cleans the remover 5. As illustrated in FIG. 3, the cleaner 6 includes contact members 61 that sandwich the remover 5 from the side surfaces. The contact members 61 are adjacent to the remover 5 in the +X axis direction and the −X axis direction. The portions of the contact members 61 that come in contact with the remover 5 are formed of felt. When the remover 5 is rotated, the contact members 61 wipes paper dust from the remover 5 to clean the remover 5.

As described above, the cleaning apparatus 10 includes the cleaner 6 that cleans the remover 5. This configuration enables removal of paper dust from the remover 5.

Furthermore, the cleaner 6 has the contact members 61 that directly come in contact with the remover 5 to clean the remover 5. This configuration enables efficient removal of paper dust from the remover 5.

As described above, the cleaning apparatus 10 according to the present disclosure includes the cleaning roller 4 configured to rotate about the first rotation axis O1 to clean the felt roller 3, which corresponds to the component to which paper dust is attached, the cleaning roller 4 having the area A3, which corresponds to the first area, and the area B3, which corresponds to the second area adjacent to the area A3 in the direction along the first rotation axis O1 and to which more paper dust is attached than to the area A3, and the remover 5 configured to rotate about the second rotation axis O2 extending in a direction different from the first rotation axis O1 and configured to come in contact with at least a portion of the area B3 to remove paper dust from the area B3. This configuration enables efficient removal of paper dust from the cleaning roller 4. Furthermore, this configuration enables efficient cleaning of the area B3 of the cleaning roller 4 to which paper dust is more likely to attach.

Furthermore, the fiber structure manufacturing apparatus 100 according to the present disclosure includes the second web forming unit 19, which corresponds to the accumulation unit on which a fiber-containing material is accumulated to form an accumulation or the second web M8, the forming unit 20 including the calendar roller 203, which corresponds to the pressure portion that applies a pressure to the accumulation to form the accumulation into a sheet-like shape, and the cleaning apparatus 10 that cleans the calendar roller 203. The cleaning apparatus 10 includes the cleaning roller 4 configured to rotate about the first rotation axis O1 to clean the calendar roller 203 to which paper dust is attached, the cleaning roller 4 having the area A3, which corresponds to the first area, and the area B3, which corresponds to the second area, adjacent to the area A3 in the direction along the first rotation axis O1 and to which more paper dust is attached than to the area A3, and the remover 5 configured to rotate about the second rotation axis O2 extending in a direction different from the first rotation axis O1 and configured to come in contact with at least a portion of the area B3 to remove paper dust from the area B3. This configuration allows the fiber structure manufacturing apparatus 100 to have the advantages of the cleaning apparatus 10. Furthermore, this configuration enables the cleaning roller 4 to clean directly or indirectly the calendar roller 203. Thus, the calendar roller 203 can remain with no or little paper dust thereon. This enables the second web M8 to be pressurized at high precision, resulting in production of a high-quality fiber structure.

Second Embodiment

Figure 5:
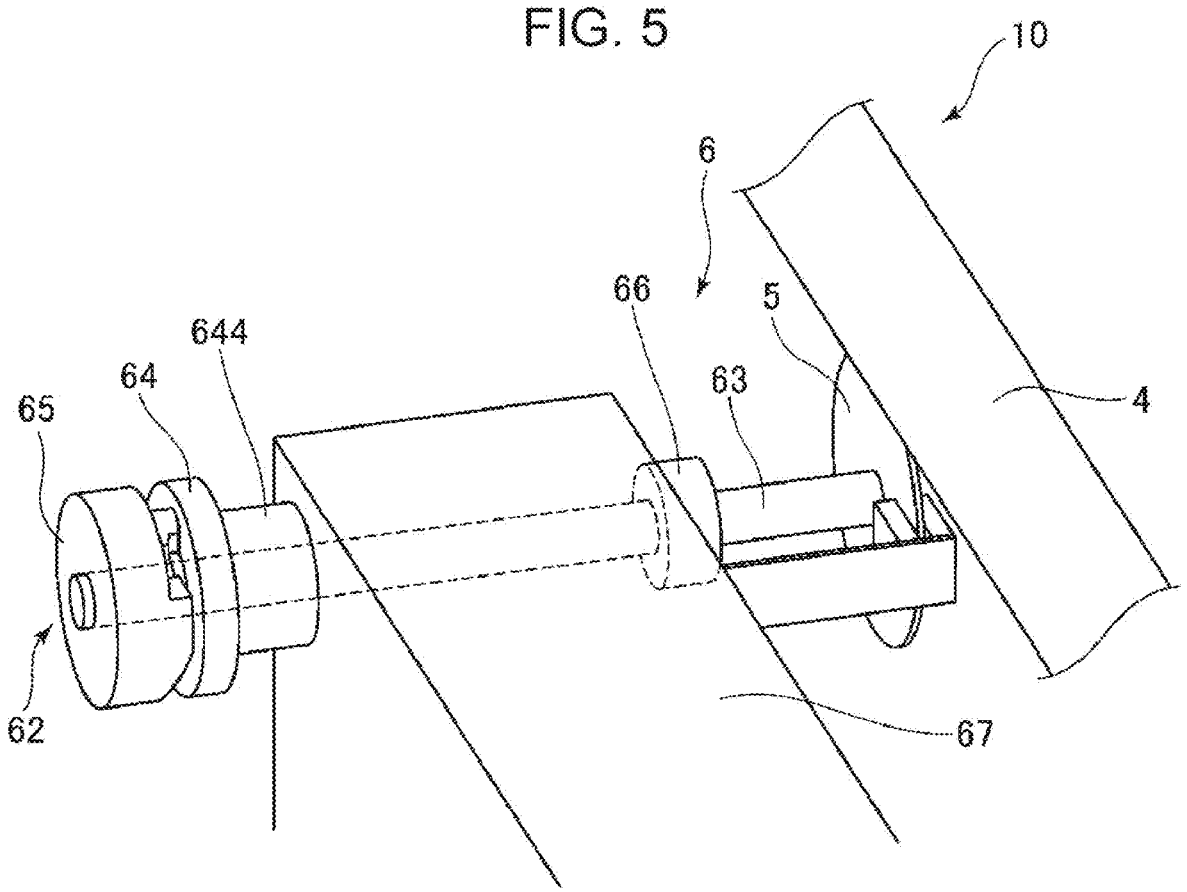
FIG. 5 is a perspective view illustrating a vibrator of a cleaning apparatus included in a fiber structure manufacturing apparatus according to a second embodiment.
Figure 6:
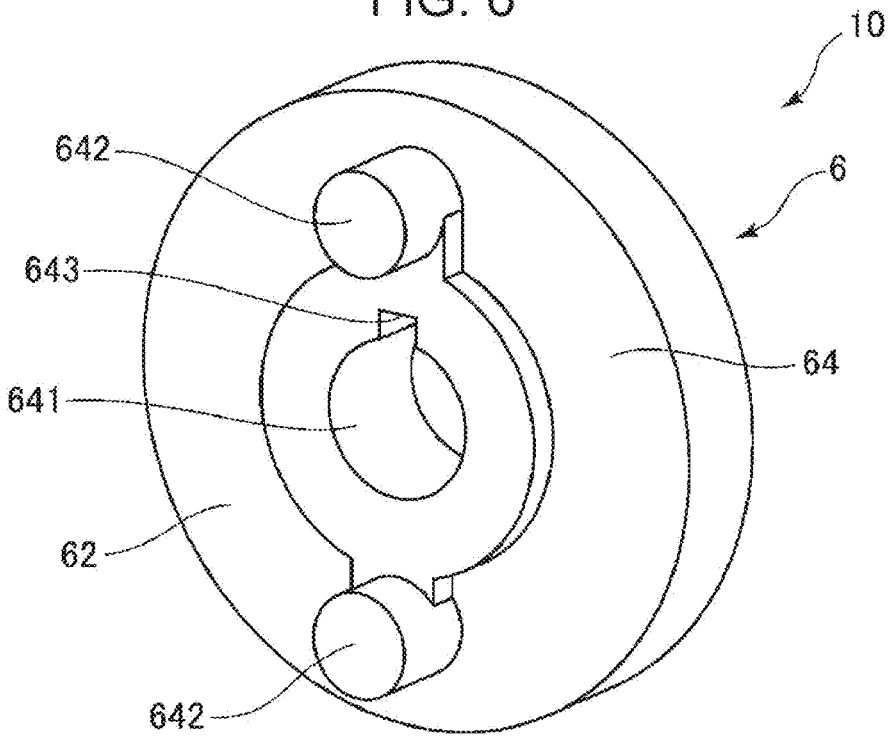
FIG. 6 is a perspective view illustrating a collision member included in the vibrator illustrated in FIG. 5.
Figure 7:
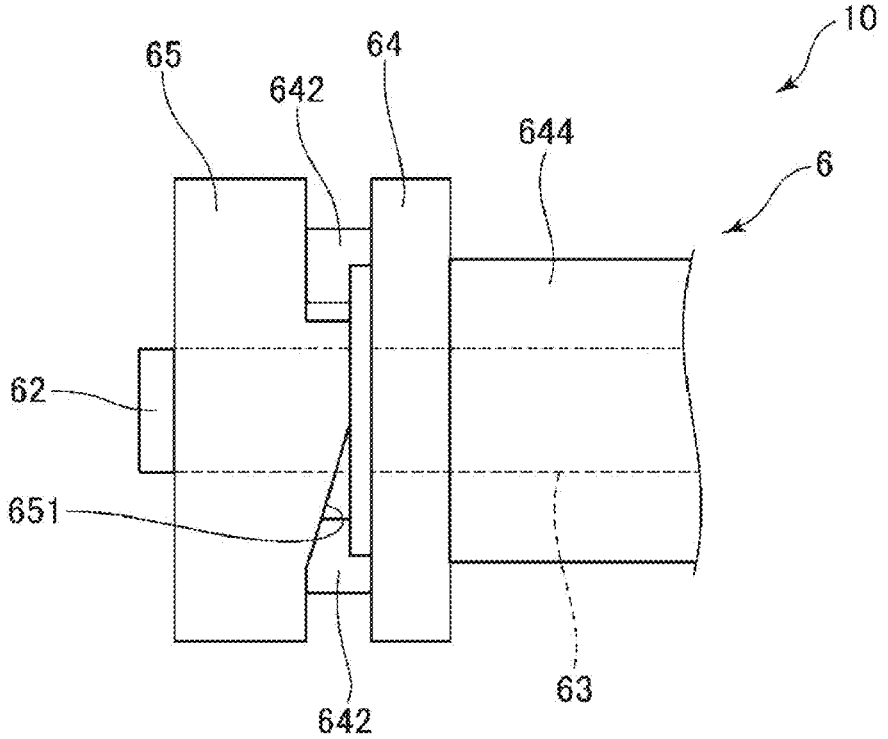
FIG. 7 is a side view of the vibrator illustrated in FIG. 5.

FIG. 5 is a perspective view illustrating a vibrator of a cleaning apparatus included in a fiber structure manufacturing apparatus according to a second embodiment. FIG. 6 is a perspective view illustrating a collision member included in the vibrator in FIG. 5. FIG. 7 is a side view of the vibrator in FIG. 5.

Hereinafter, the cleaning apparatus according to the present disclosure and the fiber structure manufacturing apparatus according to the second embodiment will be described. Differences between the above-described embodiment and the second embodiment will be mainly described, and the same points will not be described.

As illustrated in FIG. 5, in this embodiment, the cleaner 6 includes a vibrator 62 that vibrates the remover 5. The vibrator 62 includes a shaft 63 coupled to the remover 5, a collision member 64 coupled to the shaft 63, a one-way clutch 65 coupled to the shaft 63, a one-way clutch 66, and a support 67. The shaft 63 is inserted into or attached to, in this order from the left in FIG. 5, the one-way clutch 65, the collision member 64, the support 67, the one-way clutch 66, and the remover 5. The shaft 63 is rotatably supported by the support 67.

As illustrated in FIG. 6, the collision member 64 has a disc-like shape and has a through hole 641 through which the shaft 63 extends. The through hole 641 has a cut out 643. The collision member 64 has protrusions 642 protruding toward the one-way clutch 65. Two protrusions 642 are disposed with the through hole 641 therebetween.

Furthermore, the collision member 64 is urged by a spring 644 toward the one-way clutch 65. The collision member 64 having such a configuration is fixed to the shaft 63 and is rotated together with the shaft 63.

The one-way clutch 65 has a built-in gear. The one-way clutch 65 is switchable between a first state in which the one-way clutch 65 engages with the shaft 63 and rotates together with the shaft 63 and the collision member 64 and a second state in which the one-way clutch 65 slides on the shaft 63 and does not rotate together with the shaft 63 and the collision member 64.

Furthermore, as illustrated in FIG. 7, the one-way clutch 65 has a tilted surface 651 tilted toward the collision member 64. The tilted surface 651 is a portion where the protrusions 642 come in contact.

In the second state, the one-way clutch 65 and the collision member 64 rotate relative to each other. During rotation, when the protrusions 642 of the collision member 64 slide on the tilted surface 651, the collision member 64 moves away from the one-way clutch 65 against the biasing force of the spring 644. Then, when the protrusion 642 moves over the step ahead of the tilted surface 651, as illustrated in FIG. 7, the collision member 64 collides with the one-way clutch 65 due to the biasing force of the spring 644. The collision causes a vibration, and the vibration is transmitted through the shaft 63 to the remover 5. Thus, the paper dust on the remover 5 is shaken off from the remover 5.

During the movement of the collision member 64 toward or away from the one-way clutch 65, a key (not illustrated) fixed to the shaft 63 moves in the cut out 643 of the collision member 64. This enables stable movement of the collision member 64 toward or away from the one-way clutch 65.

The switching between the first state and the second state is performed preferably not less than 5 times and not more than 20 times, more preferably not less than 7 times and not more than 15 times per revolution of the cleaning roller 4. This configuration enables more reliable shaking off of the paper dust from the remover 5.

As described above, the cleaner 6 includes the vibrator 62 that vibrates the remover 5. This configuration enables cleaning of the remover 5 simply by causing a vibration.

The cleaning apparatus and the fiber structure manufacturing apparatus according to the present disclosure have been described above using the embodiments illustrated in the drawings. However, the present disclosure is not limited to the above description. The components of the cleaning apparatus and the fiber structure manufacturing apparatus may be replaced with any component that achieves the similar function to the corresponding component. Furthermore, the cleaning apparatus and the fiber structure manufacturing apparatus may include any additional component.

The cleaning apparatus and the fiber structure manufacturing apparatus according to the present disclosure may have a combination of any two or more configurations and characteristics in the above-described embodiments.

A cleaning roller that cleans the first area may be disposed between the removers. In such a case, the cleaning roller preferably rotates about a third axis parallel to the first axis.

What is claimed is:

1. A fiber structure manufacturing apparatus, comprising:

an accumulation unit including a belt on which a fiber-containing material is accumulated to form an accumulation;

a forming unit disposed downstream relative to the accumulation unit in a transport direction of the accumulation, the forming unit including a pressure portion, the pressure portion applying a pressure to the accumulation to form a sheet-like object containing fiber; and a cleaning apparatus disposed below the pressure portion, the cleaning apparatus including a cleaning roller configured to rotate about a first rotation axis to clean the pressure portion to which paper dust is attached, the first rotation axis extending the first direction, the cleaning roller having a first area and a second area that is adjacent to the first area in the first direction and to which more paper dust is attached than to the first area, and a remover configured to rotate about a second rotation axis, the second rotation axis extending in a second direction different from the first direction, the remover being configured to come in contact with at least a portion of the second area to remove the paper dust from the second area.

2. The fiber structure manufacturing apparatus according to claim 1, wherein the pressure portion is further configured to transport the sheet-like object containing fiber, and the second area corresponds to a position of an end portion in a direction intersecting a transportation direction of the sheet-like object.

3. The fiber structure manufacturing apparatus according to claim 2, wherein the first area is located at a middle in a longitudinal direction of the cleaning roller and the second area is located at both first and second end portions in the longitudinal direction of the cleaning roller, the longitudinal direction is the first direction, and the remover is defined by a first remover and a second remover, the first remover and the second remover being provided for the first and second end portions of the cleaning roller, respectively.

4. The fiber structure manufacturing apparatus according to claim 3, wherein the first remover and the second remover are configured to rotate in opposite directions.

5. The fiber structure manufacturing apparatus according to claim 1, further comprising:

a driver configured to rotate the remover; and a controller electrically connected to the driver and configured to control the driver.

6. The fiber structure manufacturing apparatus according to claim 5, wherein the controller is configured to control the driver to cause the remover to alternate rotation and suspension.

7. The fiber structure manufacturing apparatus according to claim 1, wherein the remover has a plate-like shape.

8. The fiber structure manufacturing apparatus according to claim 1, further comprising a cleaner that is disposed next to the remover in the second direction and is configured to clean the remover.

9. The fiber structure manufacturing apparatus according to claim 8, wherein the cleaner includes a contact member that directly comes in contact with the remover to clean the remover.

10. The fiber structure manufacturing apparatus according to claim 8, wherein the cleaner includes a vibrator that is coupled to the remover and is configured to vibrate the remover.

11. The fiber structure manufacturing apparatus according to claim 2, wherein the cleaning roller is a brush roller.

* * * * *